US007300241B2

(12) United States Patent
Fukudome et al.

(10) Patent No.: US 7,300,241 B2
(45) Date of Patent: Nov. 27, 2007

(54) FRONT LOADER ATTACHMENT CONSTRUCTION AND WORK VEHICLE HAVING THE ATTACHMENT CONSTRUCTION

(75) Inventors: Hiroki Fukudome, Sakai (JP); Koichi Kawaguchi, Sakai (JP); Kiyokazu Nakanishi, Kawachinagano (JP)

(73) Assignee: Kubota Corporation, Osaka (JP)

( * ) Notice: Subject to any disclaimer, the term of this patent is extended or adjusted under 35 U.S.C. 154(b) by 31 days.

(21) Appl. No.: 11/069,913

(22) Filed: Mar. 1, 2005

(65) Prior Publication Data

US 2006/0073003 A1 Apr. 6, 2006

(30) Foreign Application Priority Data

Sep. 9, 2004 (JP) ..... 2004-262819

(51) Int. Cl.
*B66C 23/00* (2006.01)

(52) U.S. Cl. ..... 414/686; 172/274

(58) Field of Classification Search ..... 414/686; 280/756; 180/311, 377, 378; 172/272–275
See application file for complete search history.

(56) References Cited

U.S. PATENT DOCUMENTS 4,755,101 A * 7/1988 Hamada et al. ..... 414/686
6,769,860 B2 8/2004 Yoshii et al.
2003/0223851 A1 12/2003 Muramoto
2004/0145172 A1 7/2004 Aoki et al.
2004/0265109 A1* 12/2004 Uchijima et al. ..... 414/686

FOREIGN PATENT DOCUMENTS

JP 2003-278176 A 10/2003

OTHER PUBLICATIONS

Kubota Model LA272, LA302, LA352, LA402 Front Loader Illustrated Parts List, Jun. 2003.
Yanmar Diesel Tractor AF645, AF650, AF655, AF660 Parts Catalog, Sep. 21, 1998.

* cited by examiner

*Primary Examiner*—Donald Underwood
(74) *Attorney, Agent, or Firm*—The Webb Law Firm

(57) ABSTRACT

An attachment construction for attaching a front loader having booms to a front of a tractor vehicle body is disclosed. The construction includes a pair of support tables projecting from the front portion of the tractor body to the right and left outer sides thereof, an engine constituting the vehicle body being disposed forwardly of the support tables, a front axle frame being secured to right and left sides of the engine, a pair of main frames disposed erect on the respective support tables for supporting the booms, and a pair of attaching brackets secured to right/left inner ends of the respective support tables for attaching the support tables to the vehicle body. Each attaching bracket includes a front attaching portion secured to the front axle frame and a rear attaching portion projecting rearwardly of the support table associated therewith and secured to a fore-and-aft intermediate portion of the vehicle body.

8 Claims, 10 Drawing Sheets

FRONT LOADER ATTACHMENT CONSTRUCTION AND WORK VEHICLE HAVING THE ATTACHMENT CONSTRUCTION

BACKGROUND OF THE INVENTION

1. Field of the Invention

The present invention relates to a work vehicle, more particularly to an attachment construction for attaching a boom of a front loader to a front of a traveling vehicle such as a tractor. The invention relates also to the work vehicle having this attachment construction.

2. Description of the Related Art

Conventionally, there is known a work vehicle comprising a tractor as an example of a traveling vehicle and a front loader mounted to the front of the tractor for use in carrying of a load, and loading/unloading operation thereof.

The vehicle body of the tractor comprises an assembly of a clutch housing, a transmission case, a differential case etc. connected in series and disposed rearwardly of an engine. The tractor includes a front axle frame fixedly attached to and projecting from the opposed sides of the engine.

The front loader includes a pair of support tables projecting from the front portion of the tractor body to the right and left outer sides thereof, a pair of boom supports disposed erect on the right and left support tables, a pair of booms pivotally connected to the tops of the right and left boom supports to be pivotable about a right/left axis, and a bucket attached to the leading ends of the right and left booms. The respective booms are vertically pivotable by means of boom cylinders interposed between the respective booms and the boom supports, and the bucket is pivotally operated by means of boom cylinders interposed between the bucket and the respective booms.

In some known front loaders, to cope with a load applied from the bucket in the course of a loader operation, to the end of reinforcement, there are provided braces extending forwardly and downwardly from the boom supports and connected to the front axle frame or connectors interconnecting the right and left boom supports to each other. In such constructions having the braces or connectors, the presence of these braces or connectors can interfere with a maintenance operation of the inside of an engine hood and/or interfere with the tractor operator's field of front vision.

In order to avoid this inconvenience, the prior art has proposed a work vehicle designed to achieve the maintenance readiness and operator's visibility by elimination of the braces or connectors (see JP-A-2003-278176).

In this work vehicle, an attaching bracket made of plate members is fixedly welded to right/left inner sides of the support tables, with a portion of the attaching bracket being bolt-fixed to the clutch housing and a front attaching portion of the attachment bracket extending from the support tables being bolt-fixed to the front axle frame.

Further, a bracket projects from each boom support and a front end portion of a sub frame disposed on each side of the vehicle body is superposed on the lateral face of the bracket and this bracket and the front end portion of the sub frame are fixed by means of a bolt and a nut having a transverse axis and a rear end portion of the sub frame is connected to a rear portion of the vehicle body.

With the above-described conventional work vehicle, the front end of the sub frame is superposed on and bolt-fixed to the lateral face of the bracket which projects downwardly from the boom support. Since the sub frame and the bracket can move, though very slightly, in the fore and aft direction relative to each other, when a load is applied from the boom via the boom support to the support table, this load is applied mainly to the attached portion of the support table relative to the vehicle body during a loader operation.

And, the arrangement that the attaching bracket for attaching the support table to the vehicle body projects forwardly is not sufficient by itself to effectively distribute the load applied from the boom to the attached portion of the support table to the vehicle during a loader operation. As a result, a significant load will be applied to the vehicle body, thus resulting in premature damage of the clutch housing.

Incidentally, in the case of the conventional work vehicle, the front portion of the sub frame is attached to the side of the boom support. Hence, when the support table, the boom support, etc. are dismounted from the vehicle body, the sub frame too will be detached therefrom. Therefore, the sub frame does not serve as a reinforcing member for the vehicle body.

In view of the above-described state of the art, a primary object of the present invention is to provide an attachment construction for a front loader which construction achieves effective distribution of a load applied to an attached portion of a support table attached to a vehicle body during a loader operation and also to provide a work vehicle having such attachment construction.

SUMMARY OF THE INVENTION

For accomplishing the above-noted object, according to one aspect of the present invention, there is proposed an attachment construction for attaching a front loader having booms to a front of a tractor vehicle body, the construction comprising:

- a pair of support tables projecting from the front portion of the tractor body to the right and left outer sides thereof, an engine constituting the vehicle body being disposed forwardly of the support tables, a front axle frame being secured to right and left sides of the engine;
- a pair of main frames disposed erect on the respective support tables for supporting the booms; and
- a pair of attaching brackets secured to right/left inner ends of the respective support tables for attaching the support tables to the vehicle body, said each attaching bracket including a front attaching portion secured to the front axle frame and a rear attaching portion projecting rearwardly of the support table associated therewith and secured to a fore-and-aft intermediate portion of the vehicle body.

For accomplishing the above-noted object, according to a further aspect of the present invention, there is proposed a work vehicle comprising:

- a traveling vehicle having a vehicle body, the vehicle body being an assembly of a clutch housing, a transmission case and a differential case connected in series and disposed rearwardly of an engine, a front axle frame being secured to and projecting from right and left sides of the engine;
- a front loader mounted to a front portion of the vehicle body and having booms;
- a pair of support tables projecting from the front portion of the tractor body to the right and left outer sides thereof; and
- a pair of main frames disposed erect on the respective support tables for supporting the booms;
- wherein a pair of attaching brackets are secured to right/left inner ends of the respective support tables for attaching the support tables to the vehicle body, said each attaching bracket including a front attaching portion secured to the front axle frame and a rear attaching portion projecting rearwardly of the support table associated therewith and secured to a fore-and-aft intermediate portion of the vehicle body.

According to one preferred embodiment relating to the work vehicle, the clutch housing and the transmission case are connected to each other via a center frame formed of sheet metal, the rear attaching portions of the respective attaching brackets being secured to the center frame.

According to another embodiment, a pair of sub frames extending on the right and left sides of the vehicle body along the fore and aft direction, said each sub frame having a front portion connected to the front axle frame and a rear portion connected to a rear portion of the vehicle body, said attaching brackets being disposed on the right and left outer sides of the sub frames, the rear attaching portion of said each attaching bracket and said each sub frame associated therewith being fastened together and secured to said center frame.

With the above-described construction, the front attaching portion of the attaching bracket projecting forwardly of the support table and secured to the right/left inner end of the support table is attached and secured to the front axle frame and the rear attaching portion of the support table projecting rearwardly of the support table is attached and secured to the fore-and-aft intermediate portion of the vehicle body. Accordingly, it has become possible to provide a construction free from the braces or connectors, yet achieving effective distribution of a load applied to an attached portion of a support table attached to a vehicle body during a loader operation.

Preferably, the right and left attaching brackets are connected to each other via a connecting member disposed downwardly of the vehicle body.

Further and other features and advantages of the present invention will become apparent upon reading the following detailed description of the preferred embodiments thereof with reference to the accompanying drawings.

Incidentally, in the following discussion, the languages "fore and aft direction", "right/left (or 'transverse') direction", "vertical direction" are used relative to the forward traveling direction of the vehicle body.

DESCRIPTION OF THE PREFERRED EMBODIMENTS

Preferred embodiments of the present invention will be described next with reference to the accompanying drawings.

Figure 1:
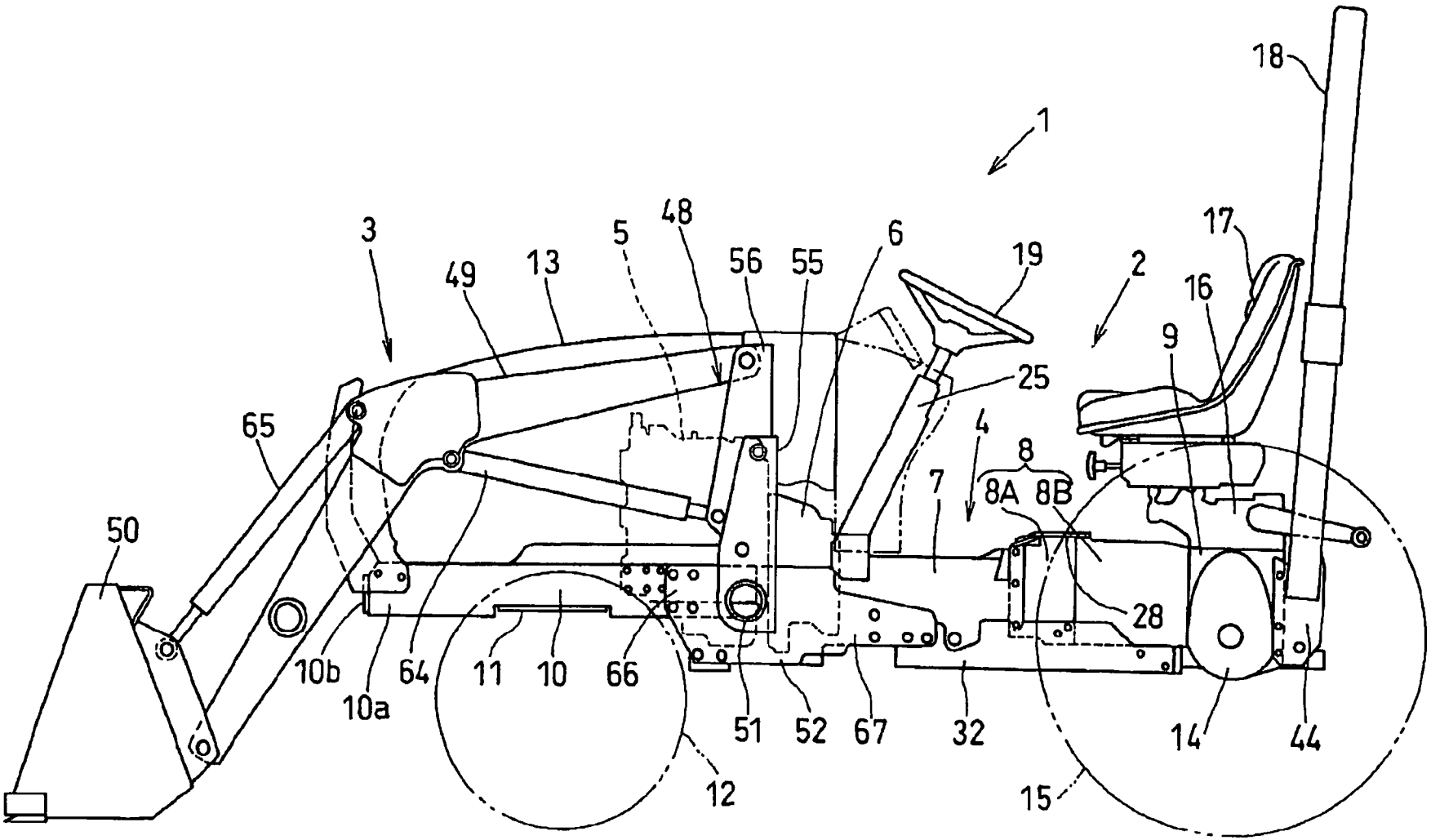
FIG. 1 is an overall side view of a work vehicle relating to one preferred embodiment of the present invention.
Figure 2:
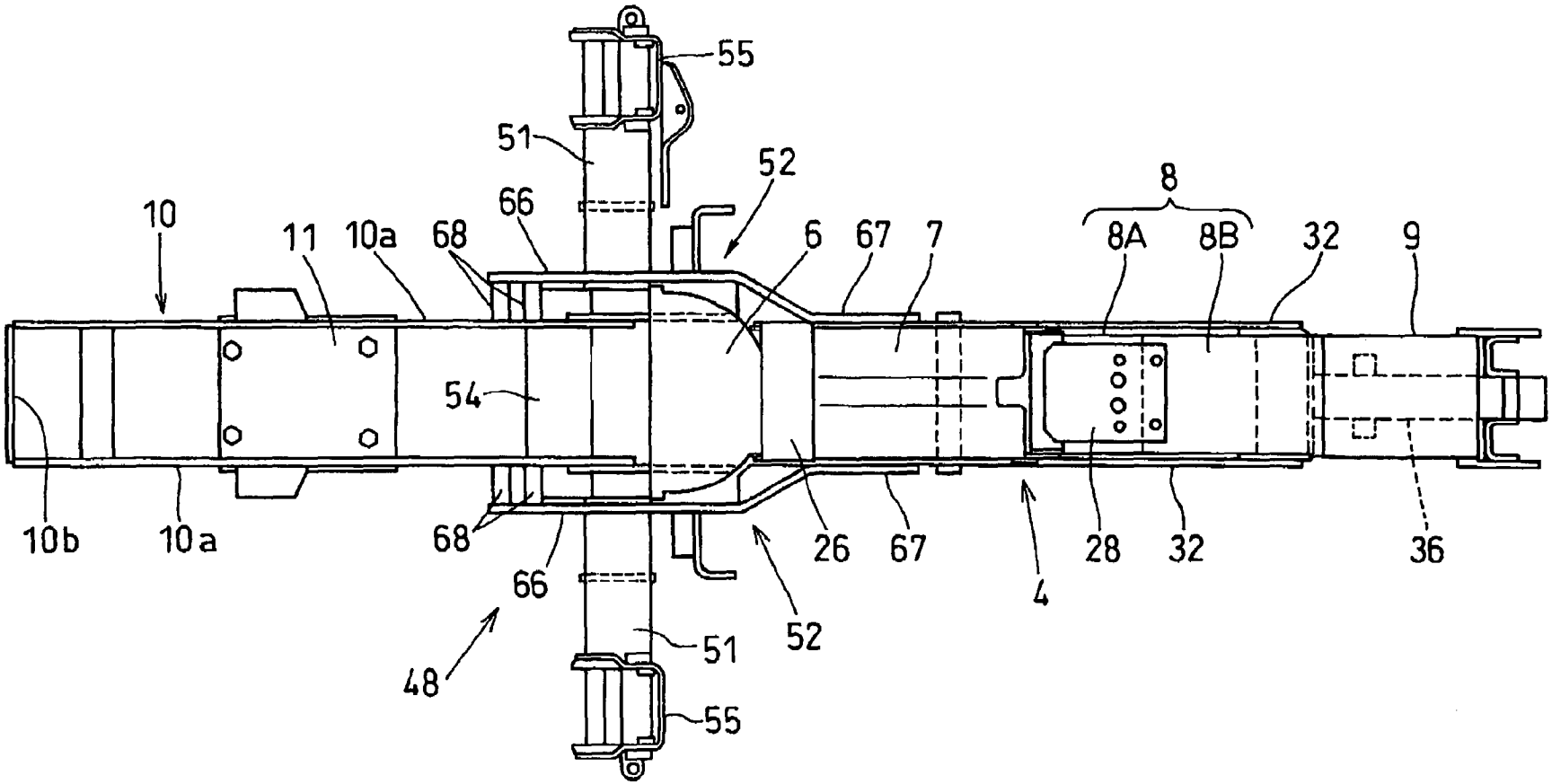
FIG. 2 is a plan view showing a vehicle body of the work vehicle.

In FIGS. 1 and 2, numeral 1 denotes a work vehicle comprising a tractor (traveling vehicle) 2 and a front loader 3 mounted to a front portion of the tractor 2.

A vehicle body 4 of the tractor 2 comprises a series-connected assembly disposed rearwardly of an engine, the assembly comprising a clutch housing 6, a center frame 7, a transmission case 8, and a differential case 9.

A crank case of the engine 5, the clutch housing 6, the transmission case 8 and the differential case 9 are cast-iron components, whereas the center frame 7 is formed of sheet metal comprising an assembly of plate members. This center frame 7 interconnects the clutch housing 6 and the transmission case 8 with each other.

To the right and left opposed sides of the engine 5, there is bolt-fixed a front axle frame 10 which projects forwardly from the engine 5. This front axle frame 10 is formed of sheet metal, and includes a pair of right and left side plates 10*a* and a front plate 10*b* interconnecting front ends of the right and left side plates 10*a*, with rear portions of the side plates 10*a* being bolt-secured to lower portions of the side faces of the engine 5.

To an attaching plate 11 provided on the lower face of the front axle frame 10, a front axle case extending transversely is supported to be pivotable about a fore and aft axis. Front wheels 12 as steerable wheels are supported to right and left sides of the front axle case.

The front axle frame 10 mounts thereon such components as a radiator, a battery, etc. The engine 5, the radiator, the battery, etc. are covered with a hood 13.

In the instant embodiment, the transmission case 8 consists essentially of a front case 8A and a rear case 8B. The front case 8A accommodates therein a hydrostatic transmission (HST) capable of feeding pressure fluid to a hydraulic motor from a hydraulic pump driven by power of the engine 5 and outputting power from the hydraulic motor for providing steplessly changed speed and selectively providing forward traveling condition and reverse traveling condition. Whereas, the rear case 8B accommodates therein a gear speed changer mechanism.

To each of right and left opposed sides of the differential case 9, there are connected a brake case and a rear axle case 14 in series. The right and left rear axle cases 14 support rear wheels 15. On the upper face of the differential case 9, thee is provided a hydraulic cylinder 16 for lifting up/down a three-point link mechanism attached to the rear of the differential case 9. Upwardly of this hydraulic cylinder 16, there is supported an operator's seat 17. Rearwardly of the operator's seat 17, there is provided a ROPS (rollover protection system) 18 and forwardly of the operator's seat 17, a steering wheel 19 is provided.

The rotational output of the engine 5 is transmitted via a clutch mounted within the clutch housing 6 and a transmission shaft disposed inside the center frame 7 along the fore and aft direction to the HST accommodated inside the front case 8A of the transmission case 8. Then, the power from this HST is transmitted via the gear speed changer mechanism accommodated inside the rear case 8B and differential gears mounted inside the differential case 9 to the respective rear wheels 15, whereby the rear wheels 15 are rotatably driven.

Incidentally, the differential case 9 may be formed integral with the transmission case 8. Also, the front face 8A and the rear case 8B of the transmission case 8 may be formed integral with each other.

Figure 5:
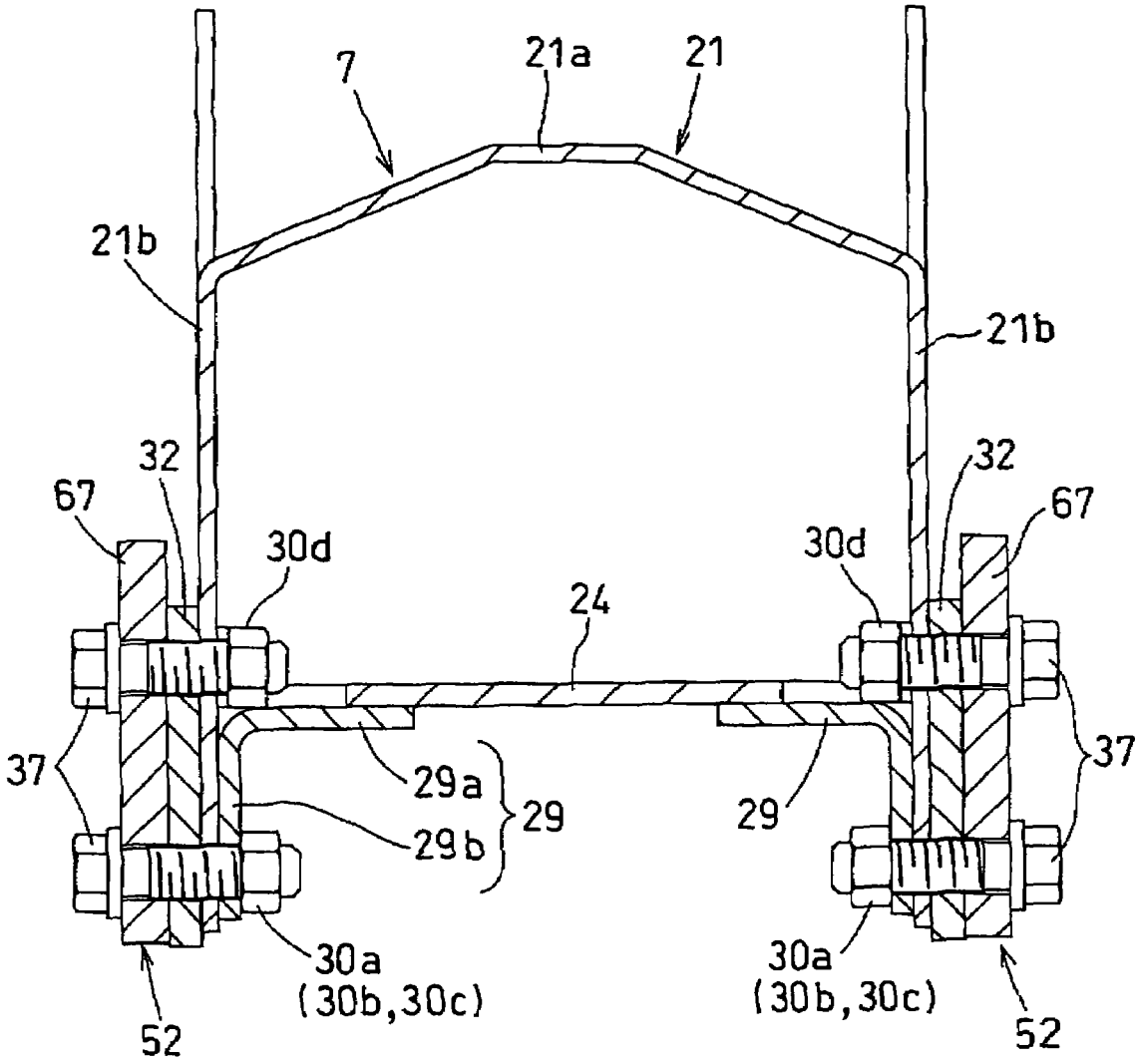
FIG. 5 is a front view in section showing a rear attaching portion of an attaching bracket.
Figure 6:
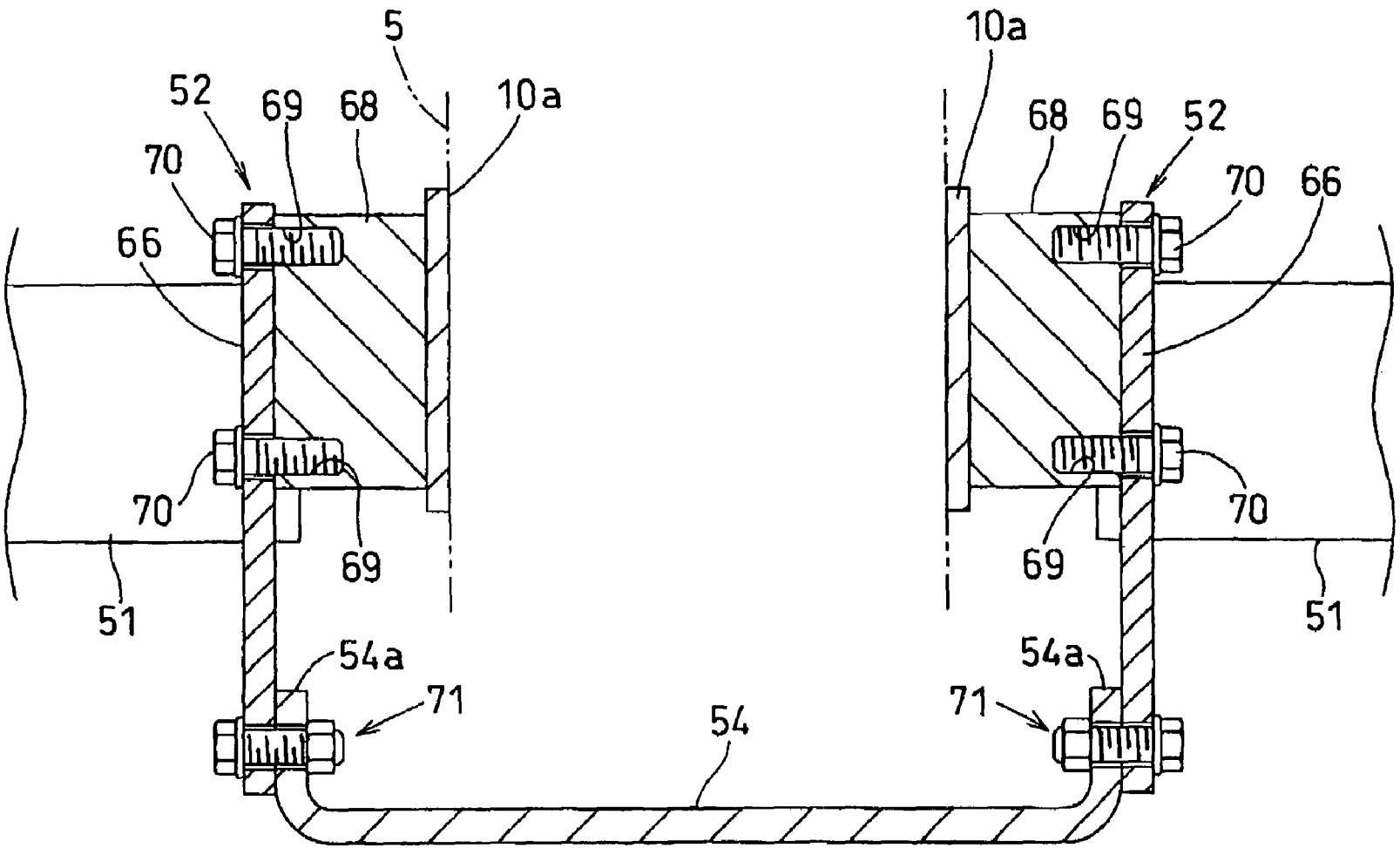
FIG. 6 is a front view in section showing a front attaching portion of the attaching bracket, FIG. 7 a side view in partial section showing a connected portion between a clutch housing and a transmission case, FIG. 8(*a*) is a front view of a center frame, FIG. 8(*b*) being a side view thereof, FIG. 8(*c*) being a plan view thereof, FIG. 8(*d*) being a rear view thereof.
Figure 7:
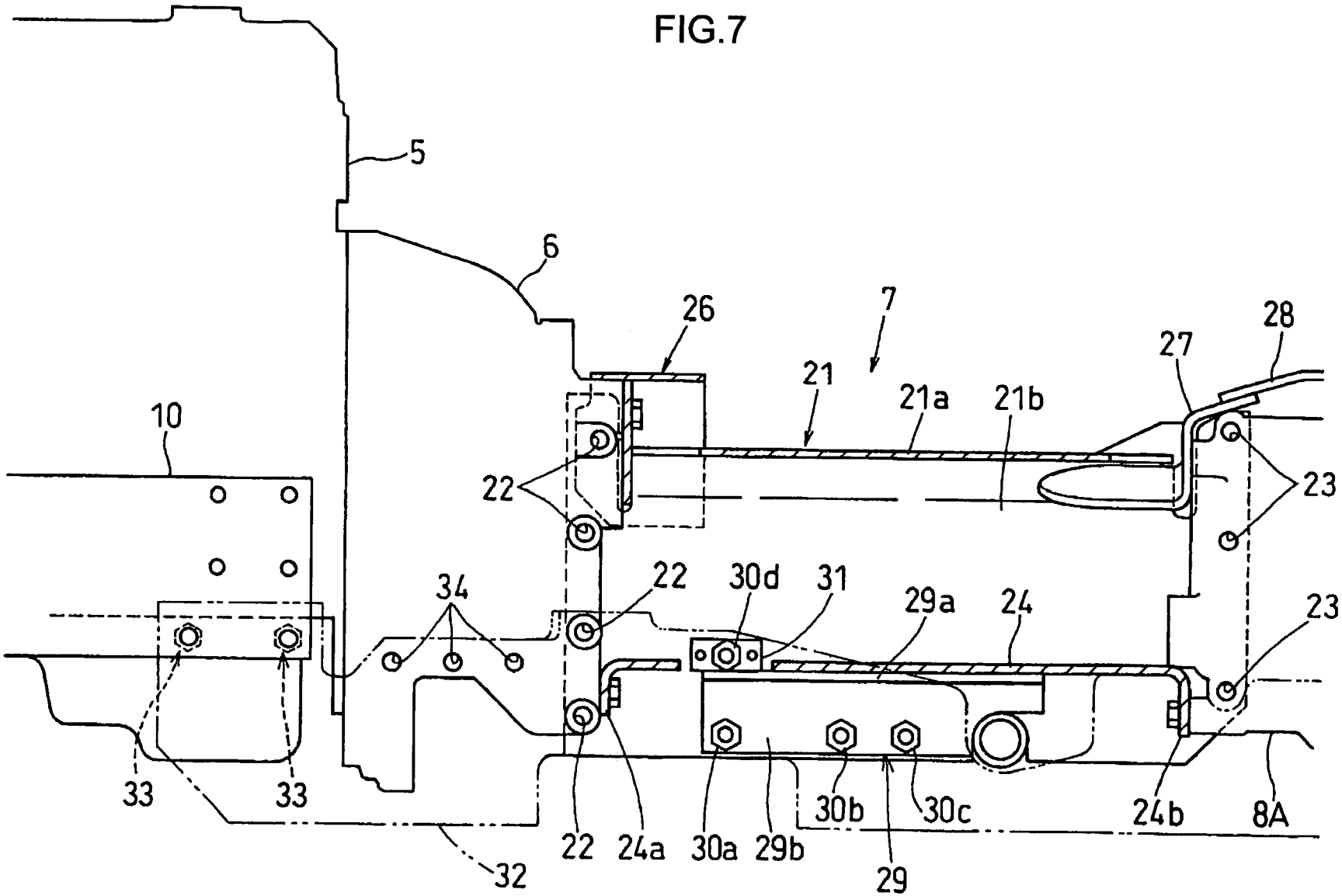
Figure 8:
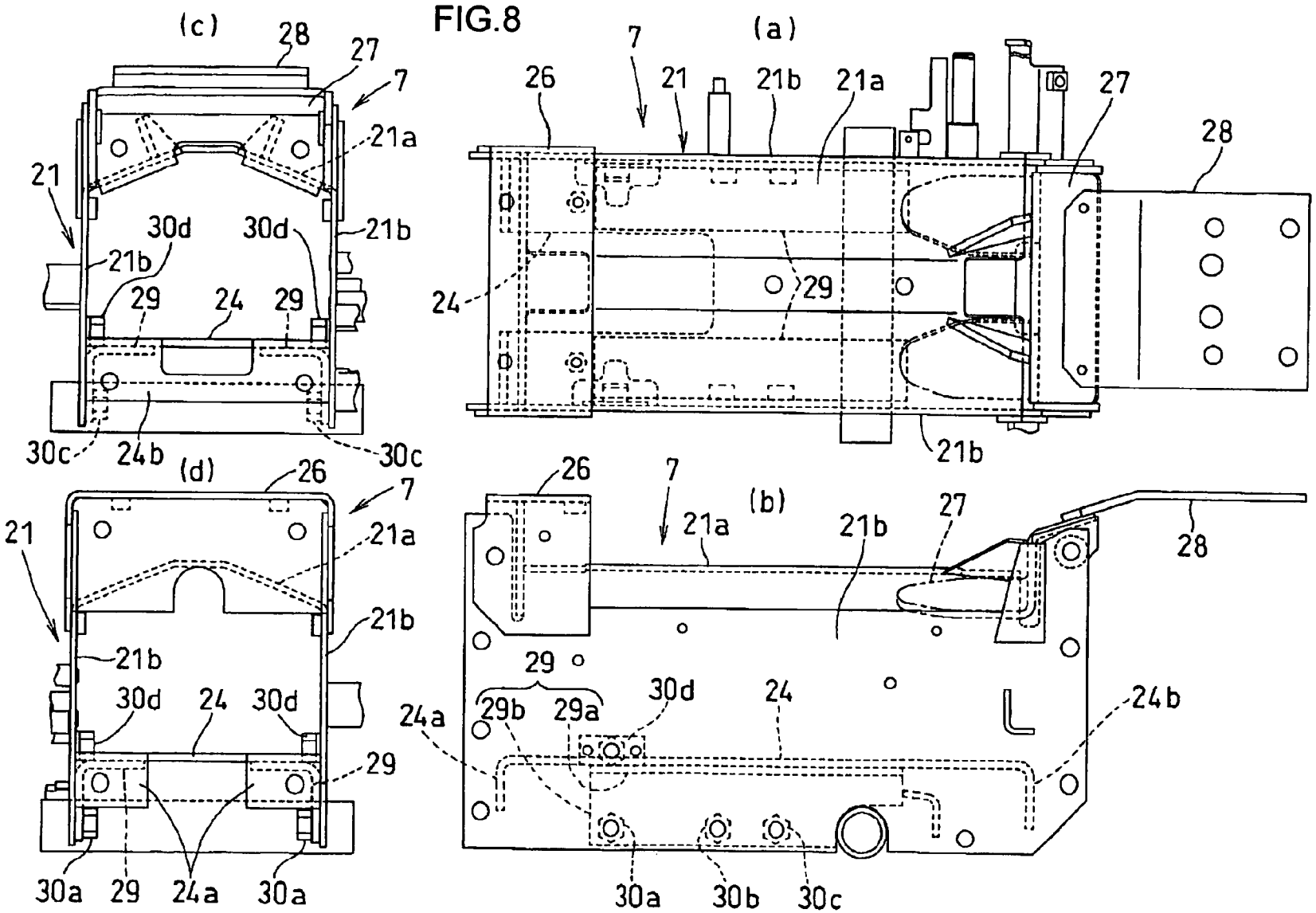
Figure 9:
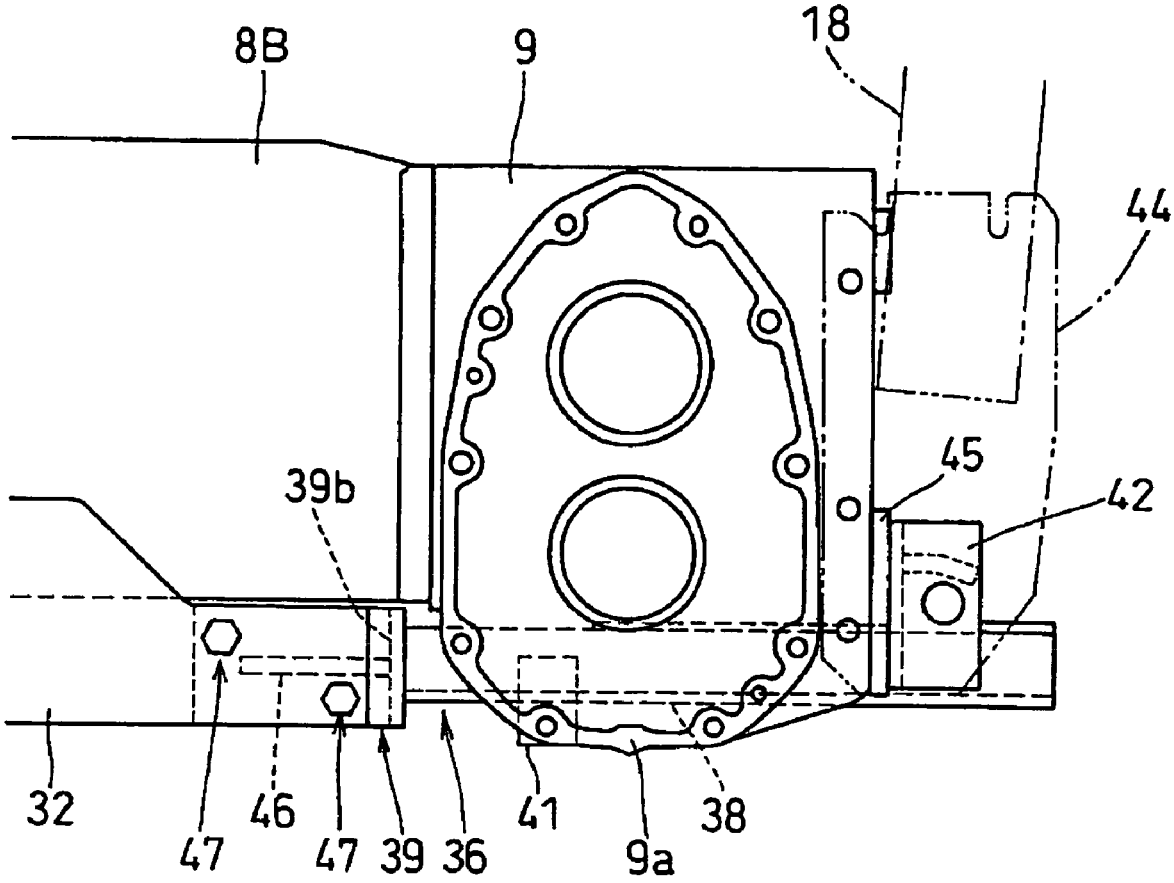
FIG. 9 is a side view showing a rear portion of the vehicle body.
Figure 10:
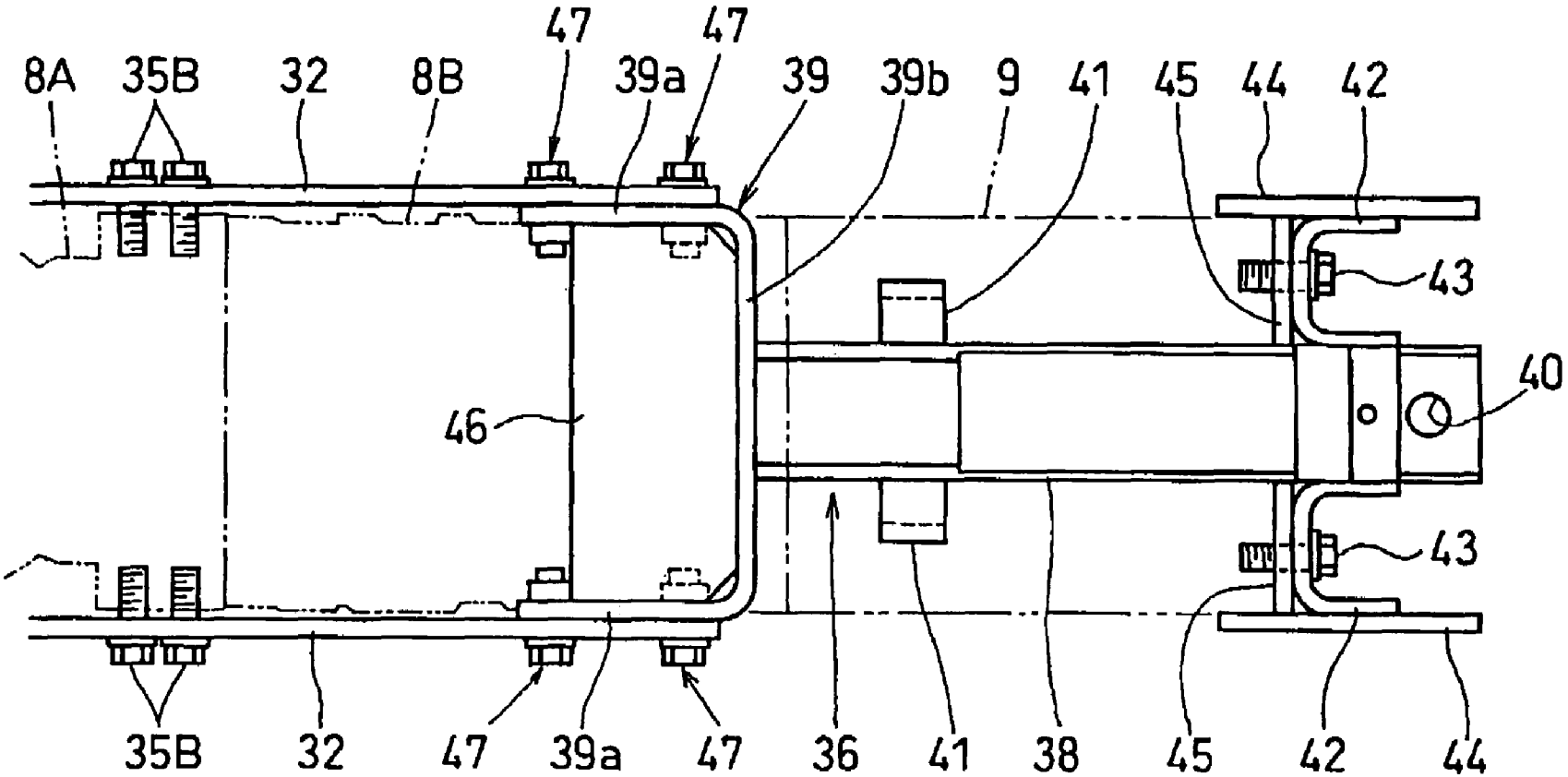
FIG. 10 is a plan view of the rear portion of the vehicle body.

As shown in FIG. 5, FIG. 7 and FIG. 8, a main frame member 21 of the center frame 7 is configured into as a downwardly open, angular hooked component including an upper wall 21*a* and right and left side walls 21*b* and this main frame member 21 extends along a length from the clutch housing 6 to the transmission case 8. Front ends of the right and left side walls 21*b* are attached and secured to the clutch housing 6 by means of bolts which extend through the side walls 21*b* and are threaded into threaded holes 22 provided vertically apart from each other in the side face of the clutch housing 6. Also, rear ends of the right and left side walls 21*b* are attached and secured to the transmission case 8 by means of bolts which extend through the side walls 21*b* and are threaded into threaded holes 23 provided vertically apart from each other in the side face of the front case 8A of the transmission case 8.

At a lower portion between the right and left side walls 21*b* of the main frame member 21, there is disposed a bottom plate member 24. Right and left opposed sides of this bottom plate member 24 are fixedly welded to the inner sides of the side walls 21*b* of the main frame member 21. Front and rear portions of the plate member 24 are bent downwardly, with a front bent portion 24*a* thereof being bolt-secured to the clutch housing 6 and a rear bent portion 24*b* thereof being bolt-secured to the front case 8A of the transmission case 8.

Further, at a front upper portion of the main frame member 21, there is fixed an attaching table 26 to which a support frame 25 for supporting the steering wheel 19 is attached. At a rear upper portion of the main frame member 21, there is fixed a reinforcing plate 27, to which there is bolt-fixed a reinforcing plate 28 extending rearwardly from the reinforcing plate 27. The latter reinforcing plate 28 is bolt-fixed to the upper faces of the front case 8A and the rear case 8B of the transmission case 8 (see also FIG. 1 and FIG. 2).

Also, downwardly of a fore-and-aft mid position between the right and left side walls 21*b* of the main frame member 21, there are provided a pair of right and left reinforcing members 29. Each reinforcing member 29 is configured as an L-shaped component consisting of an upper wall portion 29*a* contacting the bottom face of the bottom plate member 24 and a side wall portion 29*b* contacting the inner face of the side wall 21*b* of the main frame member 21 and the reinforcing member is fixedly welded to the bottom plate member 24 and the side wall 21*b* of the main frame member 21.

To the inner face of the side wall portion 29*b* of each of the right and left reinforcing members 29, there are fixedly welded three nuts 30*a*, 30*b*, 30*c* spaced apart from each other in the fore and aft direction. Another nut 30*d* is provided upwardly of the forward-most nut 30*a*. The further nut 30*d* is fixedly welded to a plate 31 fixedly welded to the inner face of the side wall 21*b* of the main frame member 21.

Incidentally, the bottom plate member 24 defines a cutout for avoiding interference with the plate 31, etc.

As shown in FIGS. 1-5, FIG. 7, FIGS. 9-10, on the right and left sides of the vehicle body 4 of the tractor 2, there are provided a pair of sub frames 32 disposed along the fore and aft direction. Each sub frame 32 is formed of plate members and serves to reinforce the vehicle body 4.

Each right/left sub frame 32 has a length extending from the engine 5 to the rear end of the transmission case 8. A front portion of each sub frame 32 is coupled with a rear end lower portion of the side plate 10*a* of the front axle frame 10 by means of fasteners 33 comprising bolt and nut. Also, this front portion of each sub frame 32 is secured by means of a bolt 35A extending through the sub frame 32 and threaded into a threaded hole 34 defined at a lower portion in the side face of the clutch housing 6. A rear portion of each sub frame 32, on the other hand, is secured to a lower portion of the front case 8A of the transmission case 8 by means of a further bolt 35B. Also, the rear portion of each sub frame 32 is connected to the vehicle body 4 via a haul hitch 36 fixedly attached to the differential case 9.

Further, a fore-and-aft intermediate portion of each right/left sub frame 32 is attached and secured by means of bolts 37 which extend, from the right/left outer side, through the sub frame 32, the side wall 21*b* of the main frame member 21 of the center frame 7, and the side wall portion 29*b* of the reinforcing member 29 to be threaded into the nuts 30*a*, 30*b*, 30*c*, 30*d* provided on the lower inner side portions of the side wall 20*b* of the main frame member 21 of the center frame 7.

The haul hitch 36 includes a principal member 38 disposed at the transverse-center portion downwardly of the differential case 9 along the fore and aft direction and an attaching stay 39 fixedly attached to the front end of the principal member 38.

A rear portion of the principal member 38 is formed as a projection projecting rearwardly from the differential case 9 and defines a through hole 40 for allowing insertion of a connector pin for connecting a haul type implement.

Further, at front and rear portions of the principal member 38, there are provided pairs of right and left brackets 41, 42, respectively. The front-side brackets 41 are bolt-secured to brake case attaching portions 9*a* provided on the right and left opposed sides of the differential case 9. The rear-side brackets 42 are disposed adjacent the rear face of the differential case 9 and are secured to the rear face of the differential case 9 by means of bolts 43.

Incidentally, in the present embodiment, between each rear-side bracket 42 of the haul hitch 36 and the differential case 9, there is interposed a plate 45 which is secured to an attaching plate 44 provided at a lower portion of a support column of the ROPS 18, with this plate 45 being fastened and fixed to the differential case 9 together with the rear-side bracket 42. Also, the attaching plate 44 provided at the lower portion of the support column of the ROPS 18 is bolt-secured to the rear end of the side face of the differential case 9.

The attaching stay 39 is disposed downwardly of the rear end of the transmission case 8 and is configured into an angular hook shaped component in plan view consisting essentially of right and left side walls 39*a* and a rear wall 39*b* interconnecting the rear ends of the right and left side walls 39*a*. Further, between the right and left side walls 39*a* of this attaching stay 39, there is provided a reinforcing plate 46.

On outer side faces of the right and left side walls 39*a* of the attaching stay 39, rear ends of the sub frames 32 are superposed, with the rear ends of the sub frames 32 being connected to the attaching stay 39 by mans of fasteners 47 comprising bolts/nuts.

Figure 3:
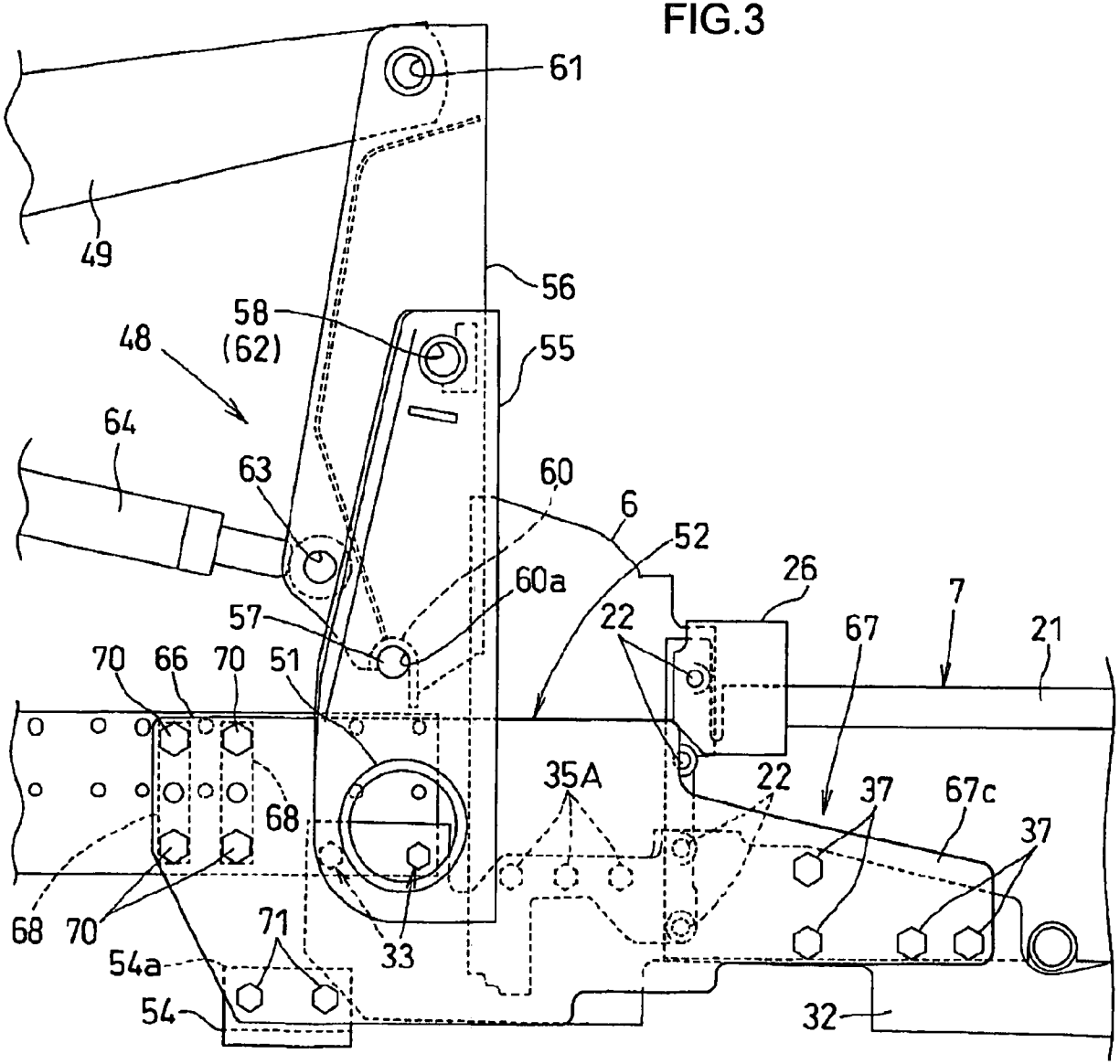
FIG. 3 is an enlarged side view of principal portions shown in FIG. 1 and showing a front loader attachment construction.
Figure 4:
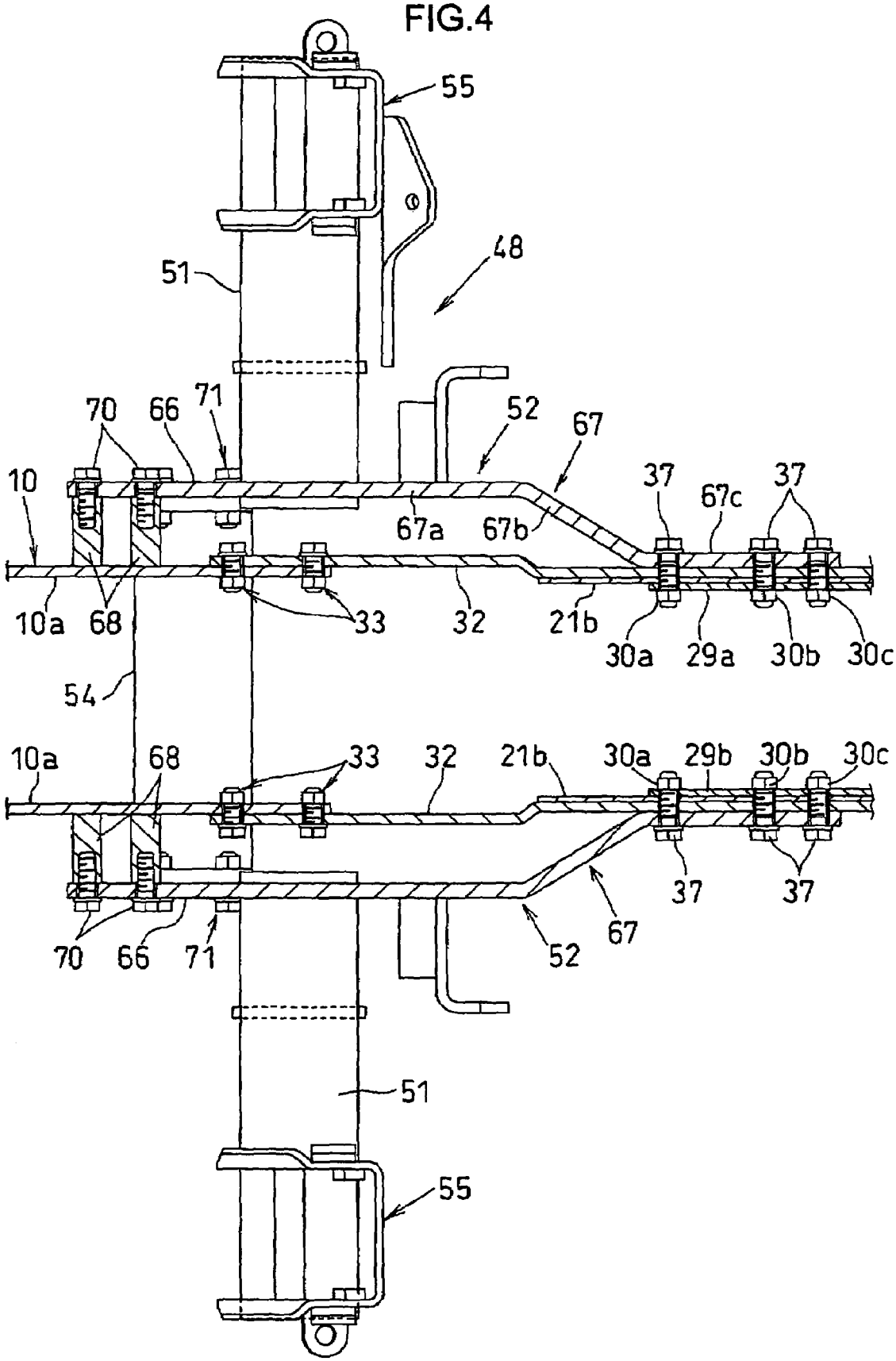
FIG. 4 is a plan view in section showing principal portions shown in FIG. 3.

As shown in FIGS. 1-3, the front loader 3 includes, as principal components thereof, an attachment unit 48 acting as an attaching portion for fixedly attaching this front loader 3 to the vehicle body 4 of the tractor 2, a pair of booms 49 disposed on the right and left opposed sides at the front portion of the vehicle body 4 and vertically pivotally supported to the attachment unit 48, a pair of boom cylinders 64 for pivoting the right and left booms 49 respectively, a pair of right and left side frames 56 for detachably attaching the booms 49 and the boom cylinders 64 to the attachment unit 48, a bucket (implement) 50 pivotally attached to the front ends of the right and left booms 49, and a pair of bucket cylinders 65 for pivotally operating the bucket 50.

The attachment unit 48 includes a pair of support tables 51 projecting from the front portion of the vehicle body 4 (beside the rear lower portion of the engine 5) to the right and left outer sides thereof, a pair of attaching brackets 52 for attaching the support tables 51 to the vehicle body 4, a pair of main frames 55 disposed erect on the respective support tables 51 for supporting the booms 49 (for attaching the side frames 56) and a connecting member 54 for interconnecting the pair of right and left attaching brackets 52.

In this embodiment, each support table 51 is comprised of a cylindrical pipe member having an axis along the right/left direction.

The main frame 55 and the side frame 56 each is formed like, in a plan view in section, a forwardly open angular hook shaped component consisting of a pair of right and left side walls and a rear wall.

At a vertically intermediate portion of the main frame 55, there is provided a support shaft 57 extending between the right and left side walls, and at an upper portion of the main frame 55, there is defined a through hole 58 extending through the right and left side walls.

Also, a right/left outer end of the support table 51 extends through lower portions of the right and left walls of the main frame 55 and fixedly welded to the main frame 55.

At a lower portion between the right and left side walls of the side frame 56, there is provided an engaging member 60 having a downwardly open arcuate recess 60*a*. At upper and lower and intermediate portions of the side frame 56, there are respectively defined through holes 61, 62, 63 extending through the right and left side walls. Then, when the side frame 56 is inserted into the space between the right and left side walls of the main frame 55 and the recess 60*a* of the engaging member 60 is engaged from above the support shaft 57 of the main frame 55, the vertically intermediate through hole 62 of the side frame 56 is in registry with the upper through hole 58 of the main frame 55. Then, by inserting a connecting pin into these through holes 58, 62, the side frame 56 is detachably attached to the main frame 55.

At an upper portion between the side walls of the side frame 56, a base end (rear end) of the boom 49 disposed on the same right or left side can be inserted, with the base end of the boom 49 being pivotally connected to the side frame 56 to be pivotable about a right/left axis by means of a pin inserted into the upper insertion hole 61 of the side frame 56.

The boom cylinder 64 is interposed between a longitudinally intermediate portion of the boom 49 and the lower portion of the side frame 56, with one end of the boom cylinder 64 being pivotally pin-connected to an intermediate portion of the boom 49, the other end of the boom cylinder 64 being pivotally connected to the side frame 56 by means of a pin inserted into the lower insertion hole 63 of the side frame 56. Hence, in association with an extending/contracting operation of the boom cylinder 64, the boom 49 is pivotally operated up/down.

The bucket cylinder 65 is attached to a front upper portion of each right/left boom 49, with one end of the bucket cylinder 65 being pivotally connected to the bucket 50, the other end of the bucket cylinder 65 being pivotally connected to a longitudinally intermediate portion of the boom 49. Then, in association with an extending/contracting operation of the bucket cylinders 65, the bucket 50 is operated for scooping or dumping action.

Incidentally, in the case of the front loader 3 having the above-described construction, the boom 49 and the boom cylinder 64 are attached to the side frame 56 which is detachably attached to the main frame 55. Alternatively, the side frame 56 may be omitted (i.e. by forming the side frame 56 integral with the main frame 55), so that the boom 49 and the boom cylinder 64 may be pivotally connected directly to the main frame 55.

As shown in FIGS. 1-6, in the instant embodiment, the attaching bracket 52 is comprised of a single plate member, with a right/left inner end of the support table 51 extending through a fore-and-aft intermediate portion of the attaching bracket 52 and fixedly welded to this attaching bracket 52.

The attaching bracket 52 is spaced apart from the right/left outer sides of the front axle frame 10 and the sub frame 32 and includes a front attaching portion 66 projecting forwardly from the support table 51 and a rear attaching portion 67 projecting rearwardly of the support table 51.

The front attaching portion 66 of the attaching bracket 52 is spaced apart from the right/left outer side of the front axle frame 10. And, the outer side face of the front axle frame 10 includes a pair of fore and aft attaching portions 68 fixed thereto by means of e.g. welding. The front attaching portions 66 of the attaching bracket 52 are attached and fixed to the front axle frame 10 by means of bolts 70 extending through the front attaching portion 66 of the attaching bracket 62 from the right/left outer side thereof to be threaded into a pair of upper and lower threaded holes 69 defined in each attaching portion 68.

Further, the rear attaching portion 67 of the attaching bracket 52 includes a front portion 67*a* thereof spaced apart from the sub frame 32 in on the right/let outer side thereof, a fore-and-aft intermediate portion 67*b* thereof inclined to be progressively closer to the sub frame 32 toward the rear side thereof, and a rear portion 67*c* thereof superposed on the outer side face of the sub frame 32. And, the rear portion 67*c* of this rear attaching portion 67 is fastened and attached together with the sub frame 32 to the center frame 7 by means of the above-described bolts 37 for attaching the fore-and-aft intermediate portion of the sub frame 32.

The connecting member 54 is comprised of a plate member which is disposed downwardly of the engine 5 along the right/left direction with right and left opposed sides thereof being bent upward. These right and left bent portions 54*a* are superposed on the inner sides of the front lower portions of the attaching brackets 52 and fixedly attached to these brackets 52 by means of fasteners 71 comprising bolts/nuts, whereby the right and left attaching brackets 52 are connected with each other.

Incidentally, the attaching brackets 52 may be bolt-secured also to the clutch housing 6. In the instant embodiment, however, the attaching brackets 52 are not directly attached to the clutch housing 6.

Also, the attaching brackets 52 cover the sides of the rear lower portion of the engine 5 and the lower portion of the clutch housing 6.

According to the present invention, as described above, by the front attaching portion 66 of the attaching bracket 52 extending forwardly of the support table 51 and bolt-secured to the front axle frame 10 and the rear attaching portion 67 extending rearwardly of the support table 51 and bolt-secured to the fore-and-aft intermediate portion (center frame 7) of the vehicle body 4, it is possible to effectively distribute the load during a work to be applied to the attached portion of the support table 51 attached to the vehicle body 4 from the bucket 50 via the booms 49, the side frames 56 and the main frame 55, thus eliminating the braces or the connectors.

Further, as the rear attaching portion 67 of the attaching bracket 52 is fixedly attached to the center frame 7 having the sheet metal construction, it is possible to prevent excessive load from being applied to the clutch housing 6 formed of cast iron.

Moreover, as the rear attaching portion 67 of the attaching bracket 52 is fixedly attached to the center frame 7 by being fastened thereto together with the sub frame 32, sufficient strength is ensured for the attached portion of the rear attaching portion 67 of the attaching bracket 32.

In addition, when the attachment unit 48 of the front loader 3 is dismounted from the vehicle body 4 of the tractor 2, the sub frame 32 will remain connected to the vehicle body 4, so that the sub frame 32 can serve as a reinforcing member for the vehicle body 4.

The invention claimed is:

1. An attachment construction for attaching a front loader having booms to a front of a tractor, the tractor comprising a vehicle body supporting an engine and a clutch housing and a transmission case disposed rearwardly of the engine, the clutch housing and the transmission case connected to each other via a center frame formed of sheet metal, a front axle frame secured to right and left sides of the engine, and the attachment construction comprising:

a pair of sub frames each having a front portion connectable to the front axle frame and a rear portion connectable to a rear portion of the vehicle body to extend on the right and left sides of the vehicle body along the fore and aft direction;

a pair of support tables for projecting from the front portion of the vehicle body to the right and left outer sides thereof, the engine being disposed generally forwardly of the support tables;

a pair of main frames disposed erect on the respective support tables for supporting the booms; and a pair of attaching brackets secured to right/left inner ends of the respective support tables for attaching the support tables to the vehicle body, said each attaching bracket including a front attaching portion securable to the front axle frame and a rear attaching portion projecting rearwardly of the support table and secured to a respective one of the sub frames such that the secured attaching bracket and sub frame are securable to the center frame at a fore-and-aft intermediate portion of the vehicle body.

2. A work vehicle comprising:

a traveling vehicle having a vehicle body, the vehicle body being an assembly of a clutch housing, a transmission case and a differential case connected in series and disposed rearwardly of an engine, a front axle frame being secured to and projecting from right and left sides of the engine;

a center frame formed of sheet metal and connecting the clutch housing and the transmission case;

a front loader mounted to a front portion of the vehicle body and having booms;

a pair of support tables projecting from the front portion of the vehicle body to the right and left outer sides thereof; and a pair of main frames disposed erect on the respective support tables for supporting the booms;

wherein a pair of attaching brackets is secured to right/left inner ends of the respective support tables for attaching the support tables to the vehicle body, said each attaching bracket including a front attaching portion secured to the front axle and a rear attaching portion projecting rearwardly of the support table associated therewith and secured to the center frame at a fore-and-aft intermediate portion of the vehicle body.

3. The work vehicle according to claim 2, wherein a pair of sub frames extending on the right and left sides of the vehicle body along the fore and aft direction, said each sub frame having a front portion connected to the front axle frame and a rear portion connected to a rear portion of the vehicle body, said attaching brackets being disposed on the right and left outer sides of the sub frames, the rear attaching portion of said each attaching bracket and said each sub frame associated therewith being fastened together and secured to said center frame.

4. The work vehicle according to claim 2, wherein the right and left attaching brackets are connected to each other via a connecting member disposed downwardly of the vehicle body.

5. The attachment construction according to claim 1, said attaching brackets being disposed on the right and left outer sides of the sub frames, the rear attaching portion of said each attaching bracket and said each sub frame associated therewith being fastened together and securable to said center frame.

6. The attachment construction according to claim 1, wherein the right and left attaching brackets are connected to each other via a connecting member disposed downwardly of the vehicle body.

7. A work vehicle comprising:

a traveling vehicle having a vehicle body, the vehicle body being an assembly of a clutch housing, a transmission case and a differential case connected in series and disposed rearwardly of an engine, a front axle frame being secured to and projecting from right and left sides of the engine;

a center frame formed of sheet metal, the clutch housing and the transmission case connected to each other via the center frame;

a pair of sub frames extending on the right and left sides of the vehicle body along the fore and aft direction, said each sub frame having a front portion connected to the front axle frame and a rear portion connected to a rear portion of the vehicle body;

a front loader mounted to a front portion of the vehicle body and having booms;

a pair of support tables projecting from the front portion of the vehicle body to the right and left outer sides thereof and a pair of main frames disposed erect on the respective support tables for supporting the booms;

wherein a pair of attaching brackets is secured to right/left inner ends of the respective support tables for attaching the support tables to the vehicle body, said each attaching bracket including a front attaching portion secured to the front axle frame, and a rear attaching portion projecting rearwardly of the support table associated therewith and fastened together, with the sub frame associated therewith, and secured to the center frame at a fore-and-aft intermediate portion of the vehicle body.

8. The work vehicle according to claim 7, wherein the right and left attaching brackets are connected to each other via a connecting member disposed downwardly of the vehicle body.

* * * * *